United States Patent [19]

Bock et al.

[11] Patent Number: 4,570,541

[45] Date of Patent: Feb. 18, 1986

[54] SAFETY DEVICE FOR GROUND IMPACT DETONATORS IN FRAGMENTATION AMMUNITION

[75] Inventors: Erich Bock, Nuremberg; Helmut Hammer, Heroldsberg; Günther Postler, Rothenbach, all of Fed. Rep. of Germany

[73] Assignee: Diehl GmbH & Co., Nuremberg, Fed. Rep. of Germany

[21] Appl. No.: 630,387

[22] Filed: Jul. 13, 1984

[30] Foreign Application Priority Data

Aug. 5, 1983 [DE] Fed. Rep. of Germany ... 8322610[U]

[51] Int. Cl.[4] ..... F42C 19/06

[52] U.S. Cl. ..... 102/216

[58] Field of Search ..... 102/216, 229, 235, 244, 102/251, 254, 255, 256, 262, 393, 396

[56] References Cited

U.S. PATENT DOCUMENTS

| | | | |
|---|---|---|---|
| 2,858,516 | 1/1975 | Rabinow | 102/216 |
| 2,980,020 | 4/1961 | Smith | 102/216 |
| 3,804,020 | 4/1974 | Norton | 102/216 |
| 3,845,714 | 11/1974 | Kaiser | 102/216 |

*Primary Examiner*—Charles T. Jordan

*Attorney, Agent, or Firm*—Scully, Scott, Murphy & Presser

[57] ABSTRACT

A safety device for ground impact detonators in fragmentation ammunition, which includes an electrical ignition circuit, a housing, and a slider with a detonator arranged in said housing and movable between the positions "secure" and "live", a primer charger fixedly located within the housing, as well as a contact pin and an electrical inertial switch.

3 Claims, 2 Drawing Figures

SAFETY DEVICE FOR GROUND IMPACT DETONATORS IN FRAGMENTATION AMMUNITION

BACKGROUND OF THE INVENTION

1. Field of the Invention

The present invention relates to a safety device for ground impact detonators in fragmentation ammunition, which includes an electrical ignition circuit, a housing, and a slider with a detonator arranged in said housing and movable between the positions "secure" and "live", a primer charge fixedly located within the housing, as well as a contact pin and an electrical inertial switch.

2. Discussion of the Prior Art

For small-calibered launched ammunition which possess electrical detonators, in order to enhance the functional dependency thereof at impact against ground, there is required a delicate, mechanical inertia switch. Upon the ejection of the launched or free-falling ammunition, which is mostly carried out in bundles or "clusters", during the separation of the small bombs which are assembled into clusters, collisions between the small bombs are unavoidable. When, upon the separation or release of the "cluster" there is initiated the activating cycle for the small bombs, then, as occasioned by the design of the ignition electronics, this can lead to a premature functioning of the inertia switch from the live position to the failure of the ignition system.

In effect, in an electrically-detonatable small bomb in which the ignition arrangement incorporates an electrical inertia switch, the separate switch which is in a secure condition, can close due to the collision impact. Consequently, the ignition system will either fail completely so as to occasion the presence of a socalled "dud" small bomb, or the bomb will detonate prematurely. As a result of the premature detonation there will be destroyed adjoining small bombs, or the aircraft which carries the bombs in a container will be damaged.

SUMMARY OF THE INVENTION

Accordingly, it is an object of the present invention to so arrange the inertia switch whereby it can be rendered effective only after an implemented live setting of the ignition system. In accordance with the present invention the foregoing object is achieved in that the slider is provided with the inertia switch, and in which the inertia switch is only located coaxial with regard to the contact terminal post during the "live" slider position, whereas in the "secure" position there is present a sidewise spacing between the inertia switch and the contact terminal post. Thereby, in a simple and inexpensive manner, is there prevented any faulty ignition of the detonator in the "secure" position of the slider. Consequently, this will securely eliminate the failure of the ignition system.

BRIEF DESCRIPTION OF THE DRAWINGS

Reference may now be had to the following detailed descripton of an exemplary embodiment of the invention, taken in conjunction with the accompanying drawings; in which.

DETAILED DESCRIPTION

Figure 1:
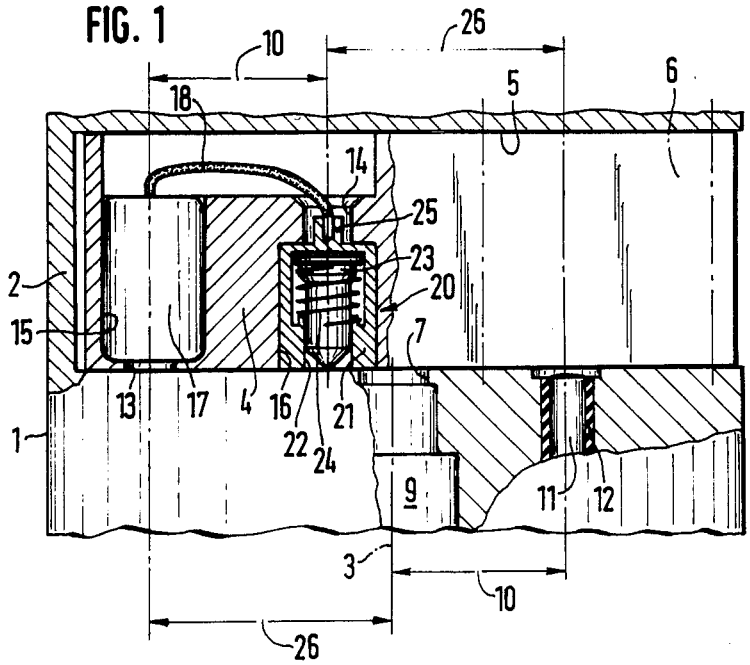
FIG. 1 illustrates a safety arrangement, shown in transverse partial section, for a small bomb in the "secure" position.

In a small bomb 1 having a housing 2, supported transverse to the longitudinal axis 3 is a slider 4 within a recess 5 of generally square cross-section 6.

Located in the housing 2 coaxially with the longitudinal axis 3 is a detonator bore 7 and an encapsulated primer charge 9. Located offset from the longitudinal axis 3 in the housing 2 at a spacing 10 is a contact terminal post 11 electrically-insulated and fixedly located within a jacket 12.

The slider 4 possesses bores 13, 14 at a spacing 10, and in recesses 15, 16 contains an encapsulated electrically-ignitable detonator 17, and an inertia switch 20 connected by means of a cable 18.

The inertia switch 20 consists of a casing 21 which is constituted of brass, including a guide portion 22, a headed pin 23, a spring 24 and a soldering projection 25.

In accordance with FIG. 1 the detonator 17 is offset by a distance 26 relative to the primer charge 9. The same is applicable to the distance between the inertia switch 20 relative to the contact terminal post 11.

Through the separation of the inertia switch in its functional plane, namely in the plane in which there is provided the open distance between the electrical contact pins 11, 23 and of the mutually spatially separate assembly of the contact pins 11, 23 in components which are movable relative to each other, in essence, the housing 1 and the slider 4, the above-mentioned problem is solved. Thus, without an additional element there is afforded that only in the "live" position of the slider 4 will the electrical inertia switch be then in the position to bridge over the safety distance between the two contacts pins 11, 23. In response to a collision impact which is encountered in the secure position, the contact pin can move within its sleeve 21; however, precluded is that there will be formed the electrical connection between the detonator 17 and the contact pin 11.

Figure 2:
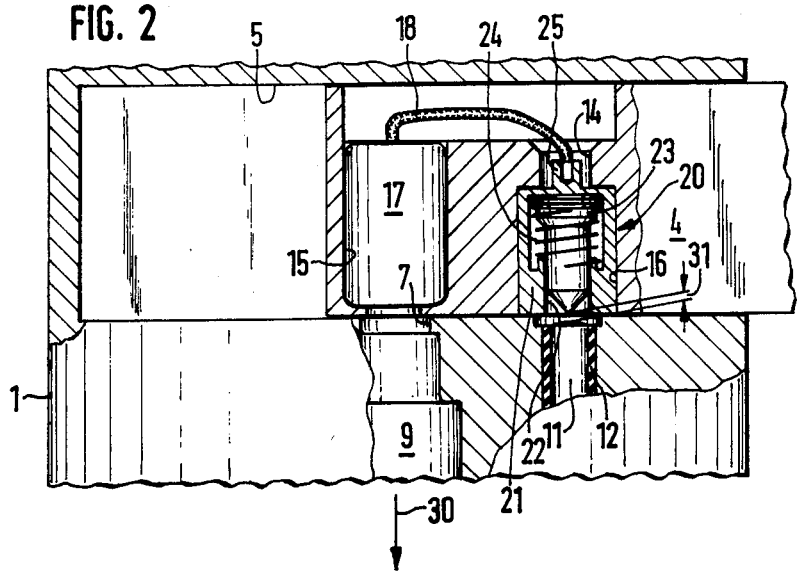
FIG. 2 illustrates the arrangement of FIG. 1 in the "live" position.

In accordance with the embodiment of FIG. 2 of the drawings, the detonator 17 is positioned coaxially with the primer charge 9. The slider 4 is thereby unlatchable in a known mechanical manner from the position "secure" and can be actuated and set from this position into the position "live". At the impact of the small bomb 1 in the direction of the arrow 30, the headed pin 23 is displaced by an extent 31 and lies against the contact terminal post 11. Only then will there be triggered the detonator 17.

In the position "secure", the detonator 17, considered from an electrical standpoint, is connected to ground and, as a result, cannot be triggered.

What is claimed is:

1. Safety device for ground impact detonators in fragmentation ammunition including an electrical ignition circuit; a housing; a slider with a detonator movable within said housing between "secure" and "live" positions; a primer charge fixedly arranged in said housing, contact terminal post; and an electrical inertia switch; the improvement comprising in that said slider incorporates said inertia switch, said inertia switch being coaxial with the contact terminal post only in the "live" position of said slider, and a sideways distance being present between the inertia switch and the contact terminal post in the "secure" position of said slider.

2. Safety device as claimed in claim 1, wherein said inertia switch comprises a sleeve with a guide portion; and a headed pin and a coil spring being axially movable within said guide portion.

3. Safety device as claimed in claim 1, wherein the slider is supported in said housing in a direction extending transverse to the direction of impact.

* * * * *